US008578646B2

(12) United States Patent
Joannes

(10) Patent No.: US 8,578,646 B2
(45) Date of Patent: Nov. 12, 2013

(54) "MOVING RED DOT" SIGHTING DEVICE

(75) Inventor: René Joannes, Herve (BE)

(73) Assignee: FN Herstal, S.A., Herstal (BE)

( * ) Notice: Subject to any disclaimer, the term of this patent is extended or adjusted under 35 U.S.C. 154(b) by 358 days.

(21) Appl. No.: 12/435,528

(22) Filed: May 5, 2009

(65) Prior Publication Data

US 2009/0265974 A1 Oct. 29, 2009

Related U.S. Application Data

(63) Continuation-in-part of application No. 11/475,134, filed on Jun. 27, 2006, now abandoned.

(30) Foreign Application Priority Data

Feb. 8, 2006 (BE) ..... 2006/0078
Feb. 12, 2009 (BE) ..... 2009/0078

(51) Int. Cl.
*F41G 1/30* (2006.01)

(52) U.S. Cl.
USPC ..... 42/113

(58) Field of Classification Search
USPC ..... 42/132, 111–115, 117, 102, 120, 14, 42/123
See application file for complete search history.

(56) References Cited

U.S. PATENT DOCUMENTS

| | | | | |
|---|---|---|---|---|
| 3,826,012 | A * | 7/1974 | Pachmayr | 42/122 |
| 5,084,780 | A * | 1/1992 | Phillips | 359/350 |
| 5,205,044 | A * | 4/1993 | DePaoli | 42/132 |
| 5,369,888 | A | 12/1994 | Kay et al. | |
| 5,577,326 | A * | 11/1996 | Montelin | 42/113 |
| 6,032,374 | A * | 3/2000 | Sammut | 42/122 |
| 6,111,692 | A | 8/2000 | Sauter | |
| 6,460,447 | B1 | 10/2002 | Meyers et al. | |
| 6,490,060 | B1 * | 12/2002 | Tai et al. | 359/15 |
| 6,681,512 | B2 | 1/2004 | Sammut | |
| 7,069,685 | B2 * | 7/2006 | Houde-Walter | 42/132 |
| 7,225,578 | B2 * | 6/2007 | Tai | 42/132 |
| 7,454,860 | B2 | 11/2008 | Houde-Walter | |
| 2006/0010761 | A1 | 1/2006 | Staley, III | |

FOREIGN PATENT DOCUMENTS

| | | | |
|---|---|---|---|
| DE | 32 34 289 | A1 | 3/1984 |
| EP | 0 086 764 | A1 | 8/1983 |
| JP | 8278454 | A | 10/1996 |
| JP | 2003315873 | A | 11/2003 |

OTHER PUBLICATIONS

U.S. Appl. No. 11/475,134, filed Jun. 27, 2006.
Korean Office Action issued in KR 10-2007-0009866, dated May 20, 2013, and English translation thereof.

* cited by examiner

*Primary Examiner* — Michael J. Carone
*Assistant Examiner* — Reginald Tillman, Jr.
(74) *Attorney, Agent, or Firm* — Bacon & Thomas, PLLC

(57) ABSTRACT

Improved "moving red dot" sighting device, including a fixed light source (4) and a reflecting element (17), wherein the light source (4) produces a collimated light beam (5) which is projected onto the reflecting element (17) so as to obtain a red dot or reticle which is visible to the shooter thanks to the reflection on the reflecting element (17), and whereby the beam (5) is projected onto the reflecting element (17) by means of a rotating mirror (9) whose inclination angle (B) in relation to the light beam (5) can be adjusted.

20 Claims, 5 Drawing Sheets

"MOVING RED DOT" SIGHTING DEVICE

This is a continuation-in-part of application Ser. No. 11/475,134 filed Jun. 27, 2006, claiming priority under 35 USC §119 of Belgium Patent Application No. 2006/0078 filed Feb. 8, 2006, this application claiming priority under 35 USC §119 of Belgium Patent Application No. 2009/0078 filed Feb. 12, 2009.

BACKGROUND OF THE INVENTION

1. Field of the Invention

The invention concerns a "moving red dot" sighting device.

One of the most frequently used types of sighting devices for firing arms applies what is called the red dot technique, which consists in projecting, through the sighting optics, a light point, or more generally a light reticle, in such a manner that the shooter only has to align this point visually with the target so as to fire precisely without any parallax error.

Traditionally, we talk of a "red dot" to indicate the light reticle used in this type of sighting device.

The actual color of the reticle may vary, provided it is visible.

Moreover, the red dot is not necessarily a dot.

In what follows, the term "red dot" will thus be used in the broad sense to indicate the light reticle, whereby the sighting device can use any visible light source whatsoever and any form of reticle.

2. Discussion of the Related Art

Applying the so-called red dot technique to the firing of ammunitions that have a non-flat ballistic trajectory, as is the case when firing grenades, requires the realization of a moving red dot whose height must be adjusted as a function of the distance of the target, such that the shooter obtains the correct elevation of his fire arm by aligning the displaced dot with the target.

What makes it difficult to realize a sighting device with a moving red dot is that the range and angular resolution required for firing grenades up to several hundred meters require expensive and sizeable devices.

The so-called "moving red dot" sights with which have been introduced so far for firing ammunitions with a curved trajectory are usually based on the use of an LCD screen or a series of LEDs placed in the focal plane of a lens, whose moving image is superimposed in the sighting field of the shooter by a system of fixed mirror or prism and a beamsplitter.

Given the elevation angle to be covered, for example of more than 30° in the case of a low-velocity grenade, and the required angular resolution, such a system takes up tens of millimeters in width and in height, which is quite bulky.

A disadvantage of such a bulky sighting device is that it is not very appropriate to be used on an individual light fire arm.

Another disadvantage of such a sighting device is that, when it is placed on the upper rail of a gun, it is usually not compatible with the use of an external scope and it cannot be used when aiming with two eyes open.

Yet another disadvantage is that the existing sighting devices of this type are usually not fully ambidextrous.

SUMMARY OF THE INVENTION

The invention aims to remedy one or several of the above-mentioned disadvantages and to provide an improved sighting device with a moving red dot which is compact and which can be used on an individual fire arm.

This aim is reached according to the invention by an improved "moving red dot" sighting device, comprising a fixed light source and a reflecting element, whereby the light source produces a collimated light beam which is projected onto the reflecting element so as to obtain a red dot or reticle visible to the shooter thanks to the reflection on the reflecting surface of the reflecting element, whereby the beam is projected onto the reflecting element by means of a rotating mirror whose inclination angle in relation to the light beam can be adjusted.

In order to aim at a target, the shooter observes the target while searching the right elevation for his fire arm at which the red dot is aligned with the target, which is a sign that the fire arm is situated in the right firing position.

The shooter can aim with two eyes open by observing directly the target with the non-aiming eye and the red dot projected onto the reflecting element with the aiming eye.

However, the reflecting element is preferably a semi-transparent beamsplitter plate or beamsplitter cube, which enables the shooter to observe the target as well as the red dot through the beamsplitter with the aiming eye, while the shooter can also aim with two eyes open, whatever he prefers.

The sighting device preferably comprises a device to adjust the inclination angle of the rotating mirror in relation to the light beam, which makes it possible to adjust the sighting device by adjusting the angle of the mirror as a function of the distance of the target and the type of ammunition.

BRIEF DESCRIPTION OF THE DRAWINGS

For clarity's sake, a few embodiments of an improved "moving red dot" sighting device according to the invention are described hereafter as an example only without being limitative in any way, with reference to the accompanying drawings, in which:

FIG. 6 corresponds to FIG. 5, but for another position of the fire arm;

DESCRIPTION OF THE PREFERRED EMBODIMENT

Figure 1:
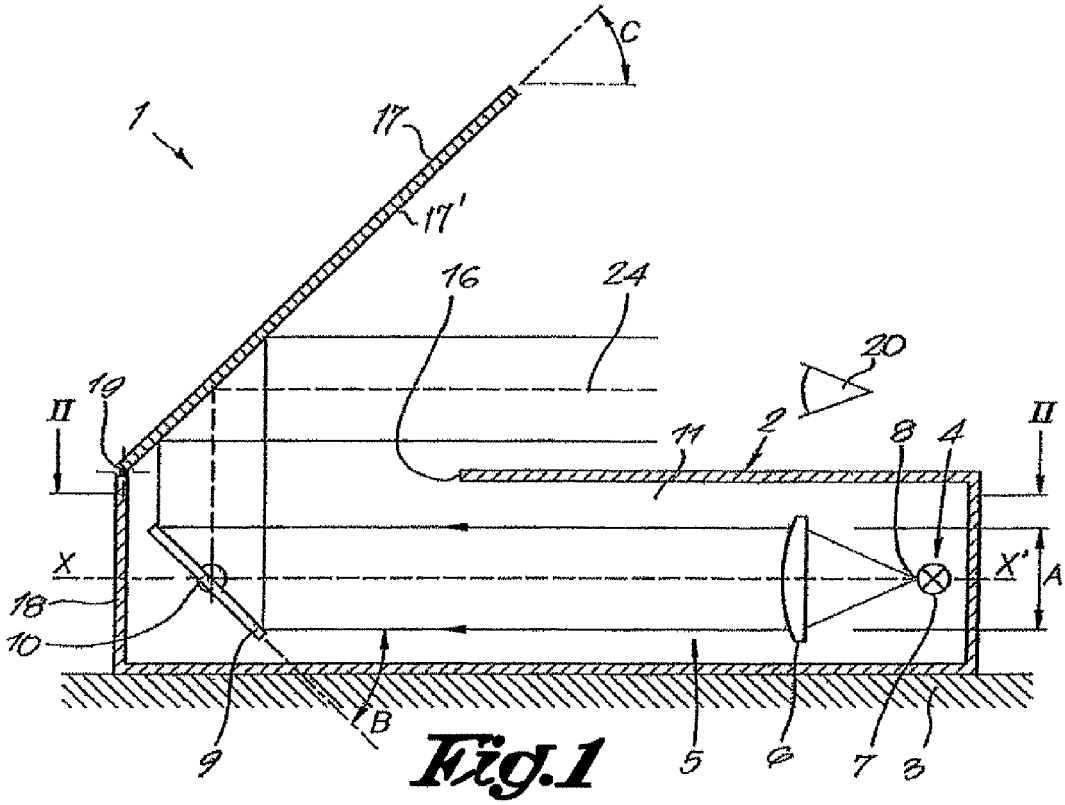
FIG. 1 is a schematic side view of an improved sighting device according to the invention.
Figure 2:
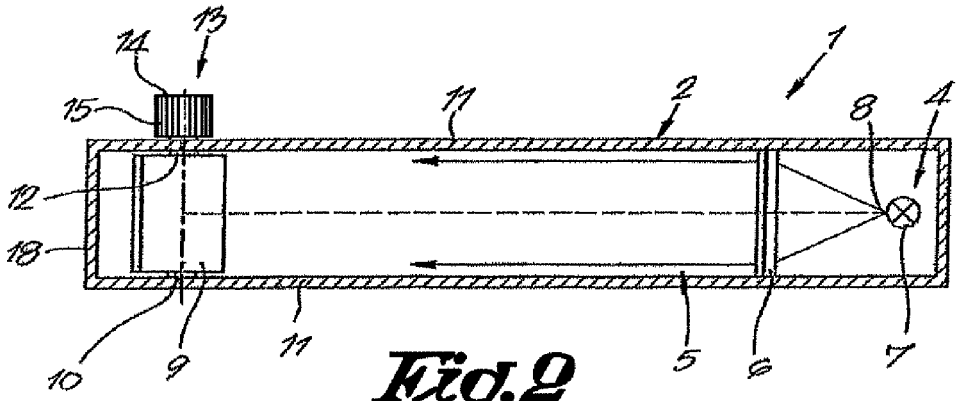
FIG. 2 is a section according to line II-II in FIG. 1.

FIGS. 1 and 2 represent an improved "moving red dot" sighting device 1 which comprises a case 2 to be mounted on a fire arm 3, whereby the case 2 extends longitudinally, mainly parallel to the axis of the barrel of the fire arm 2.

Inside the case 2 is situated a fixed light source 4, producing a collimated light beam 5 whose optical axis X-X' is in this case parallel to the axis of the barrel of the fire arm 3.

In the given example, the light source 4 is a collimator composed of a converging lens 6 and of a lamp or another luminous source 7 of quasi punctual shape with reduced dimensions, for example in the order of one tenth of a millimeter, situated in the focal point 8 of the lens 6 and producing the red dot.

The collimated light beam 5 has a diameter A in the order of 15 to 20 millimeters, which offers the advantage that the cross dimensions of the width and the height of the sighting device 1 are reduced in relation to the known sighting devices.

A mirror 9 is placed in the collimated beam 5 at an angle B in relation to the optical axis X-X' of the produced light beam 5.

The mirror 9 is mounted in a rotating manner in the case 2 and it is fixed to that end on a transversal shaft 10 mounted in a rotating manner between the side walls 11 of the case 2.

One far end 12 of the shaft 10 of the mirror 9 goes through one of the lateral walls 11 of the case 2 and is provided with an adjusting device 13 comprising a control knob 14 for the inclination angle B of the rotating mirror 9 in relation to the produced light beam 5, for example in the form of a turning knob with which the shooter can position the mirror 9 about the axis of shaft 10, which may be identified as an inclination adjustment axis, as a function of the distance of the target.

The above-mentioned control knob 14 will be provided with a scale 15 to that end representing the distance of the target.

In order to make the adjustment more precise, one can add a mechanical demultiplication to the device, such that a rotation of the button 14 results in a smaller rotation of the mirror 9.

Different adjusting buttons comprising scales that are appropriate to different types of ammunition can be realized so as to take the ballistic characteristics thereof into account.

The light beam 5 is projected through a window 16 in the case 2 onto a reflecting element 17 having reflecting surface 17' so as to produce a red dot or reticle, visible to the shooter in the reflecting element 17 which is mounted on a far end 18 of the case 2 at a fixed angle C of for example 45°, in relation to the optical axis X-X' of the produced light beam 5.

In the given example, the reflecting element 17 is a flat plate mounted on the upper side of case 2 by means of a rotary hinge 19 which makes it possible to flip down or fold the reflecting element 17 on the case 2 of the sighting device 1 when the latter is not operational, such that the whole becomes more compact.

The reflecting surface 17' preferably comprises a beamsplitter that is semi-transparent.

The use and working of the sighting device 1 are as follows.

When in rest, i.e. when aiming along the axis of the fire arm 3 with an elevation E that is zero, as represented in FIG. 1, the initial angle B of the mirror 9 is preferably 45°. The angle D is at that time 0°.

The shooter 18 estimates the distance of the target and sets the appropriate inclination B of the mirror 9 by means of the graded control button 14.

Figure 3:
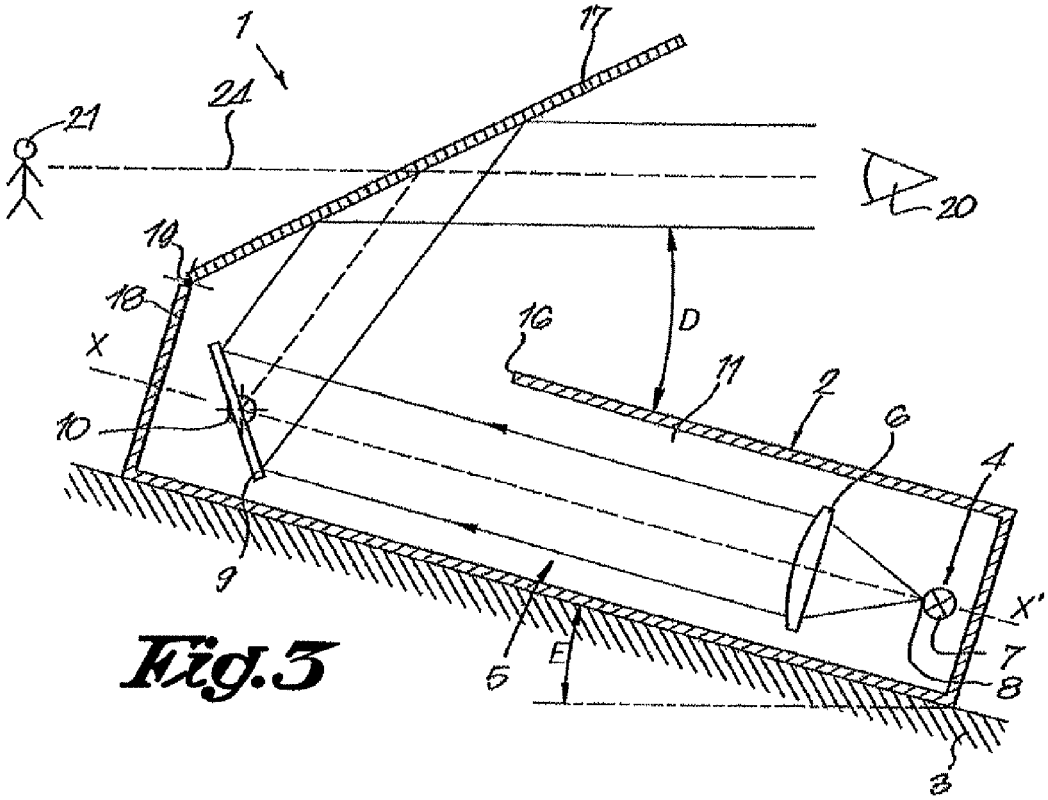
FIG. 3 represents the sighting device from FIG. 1, but in a firing position.

The light beam 5 is projected onto the reflecting surface 17' and is reflected as illustrated in FIG. 3 towards the shooter so as to produce a red dot or reticle that the shooter can observe to infinity when the eye of the shooter is situated in the light beam 5 reflected by the reflecting surface 17'.

As the mirror 9 turns, the deviation of the angle D of the beam amounts to two times that of the angle B of the mirror 9. In other words, when the mirror 9 turns for example 15° in relation to the position of rest of 45°, the angle D increases from 0° to 30°.

The inclination B of the mirror, which is a function of the distance of the target, thus determines the angle D at which the red dot can be seen by the shooter, and thus the elevation angle E that is provided to the fire arm 3, as represented in FIG. 3, when the shooter aligns the red dot or the reticle with the target 21 which, in the case where the reflecting surface 17' is a semi-transparent beamsplitter, is visible through said reflecting element 17.

If the reflecting surface 17' is not semi-transparent, the shooter will have to aim with both eyes open in order to observe the target with one eye and the red dot with the other.

Also, if the back of the semi-transparent reflecting element is dirty and cannot be aimed through, the shooter can always aim with both eyes open.

An advantage of the sighting device 1 according to the invention is that, since quasi punctual luminous source 7 is always situated in the focal point 8 of the lens 6 of the collimator, geometrical aberrations are minimized, and the lens 6 may have a small opening and thus a relatively small diameter and focal distance.

The cross dimensions of the sighting device 1, determined by the diameter A of the collimated beam, may thus be small.

In another embodiment of the sighting device 1, the adjusting device 13 for positioning the mirror 9 consists of a motor controlled by a ballistic calculator, not represented in the figures, for an automatic adjustment.

This calculator, when the distance of the target 21 is transmitted thereto, calculates the angle B to provide to the mirror 9 and activates the positioning motor.

The calculator can perform the ballistic calculation to determine the elevation angle E, taking into account the properties of the ammunitions that are being fired.

Moreover, the calculator can be combined with a range finder that automatically measures the distance of the target 21 when it is activated by the shooter.

The sighting device 1 as represented is disadvantageous in that the collimator, and thus the collimated beam, has a small diameter, which has for a result that it may be difficult for the shooter to find the angle E which guides the eye 20 into the beam 5, in other words to find the red dot.

To remedy this problem, the sighting device 1 can be adapted in the following manner.

Figure 4:
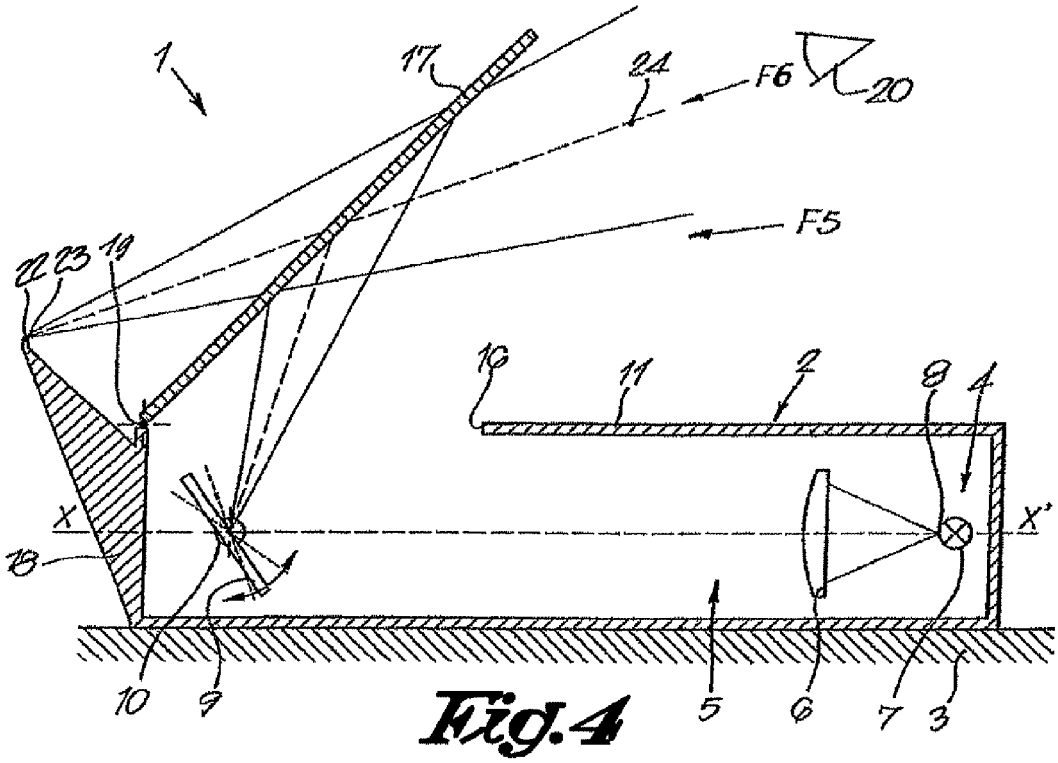
FIG. 4 represents a variant of a sighting device according to the invention.

A first adaptation consists in placing a fore-sight 22 in the point of convergence 23 of the axes of the reflected beams on the reflecting surface 17', as indicated in FIG. 4.

When the inclination angle B of the mirror 9 changes, the axis 24 of the light beam reflected on the reflecting surface 17' will still go through said point of convergence 23, irrespective of the inclination B of the mirror 9.

The point of convergence 23 actually corresponds to the symmetrical position of the axis of rotation 10 in relation to the reflecting element.

Figure 5:
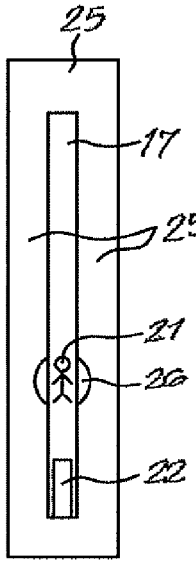
FIGS. 5 and 6 represent views in the respective directions of the arrows F5 and F6 in FIG. 4.

A second adaptation is illustrated by means of FIG. 5 and consists in providing a narrow reflecting element 17, placed in a matt, diffusing frame with two lateral strips 251, in such a manner that the incident part of the light beam on the reflecting surface of the reflecting element 17 which overflows the reflecting element 17 will be diffused by the frame 25 and will appear as a reference 26 in the form of a red spot that can be seen by the shooter, irrespective of the position of the latter's eye 20.

Figure 6:
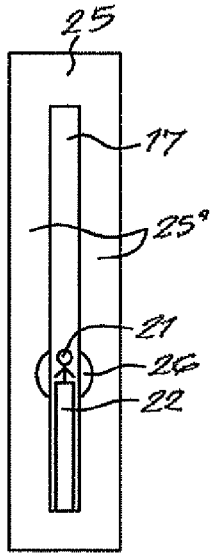

Thanks to both adaptations, the shooter will only have to align the reference formed by the spot 26 with the fore-sight 22 to find the red dot or reticle, which enables him to aim at the target 21 without any parallax or azimuth errors occurring, as represented in FIG. 6 in the case of a semi-transparent beamsplitter.

Figure 7:
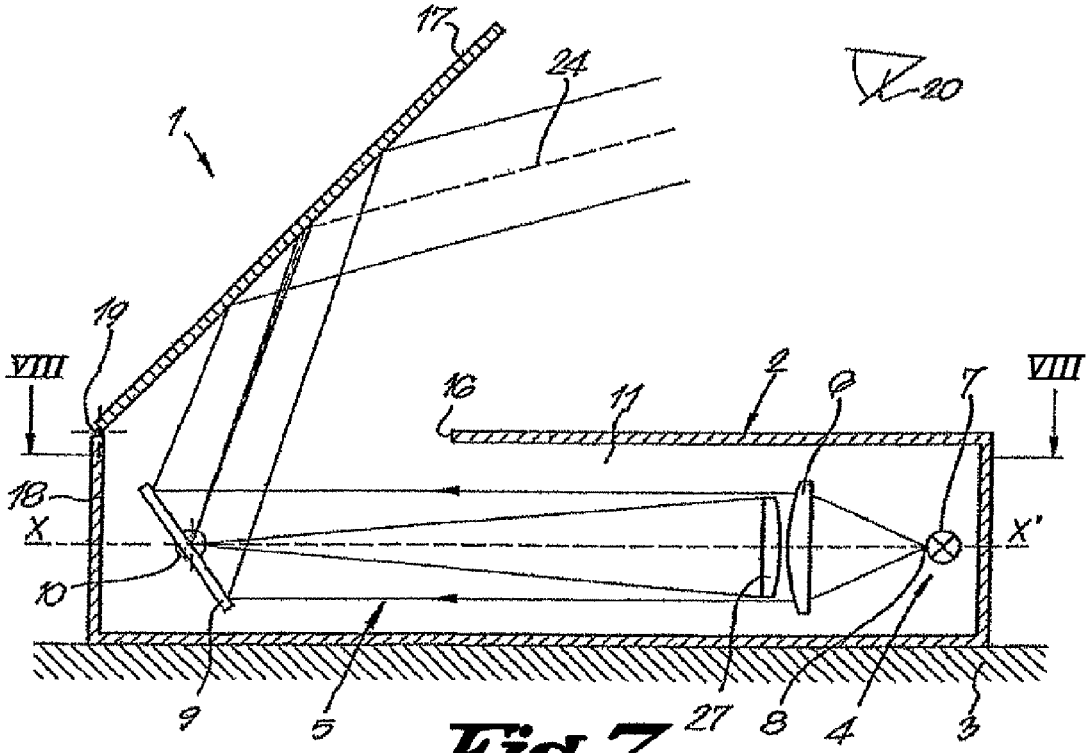
FIGS. 7 and 8 are two views similar to those in FIGS. 1 and 2, but for a variant of a sighting device according to the invention.
Figure 8:
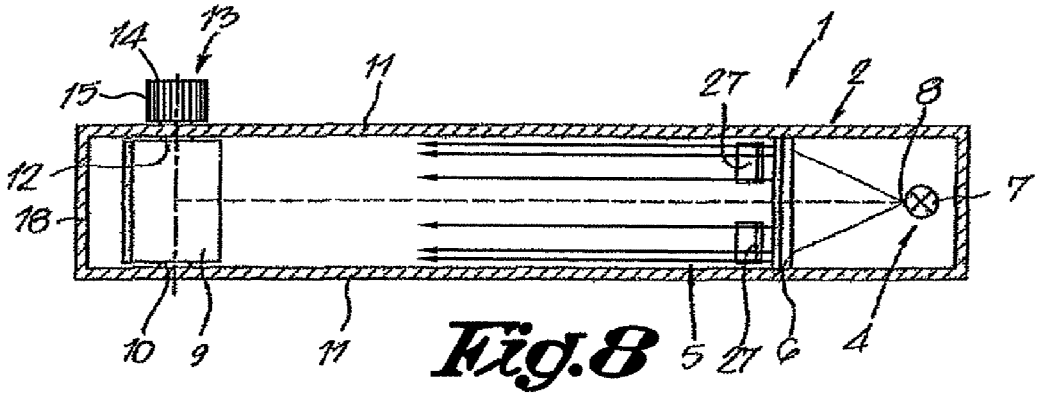

FIGS. 7 and 8 show a variant of a sighting device 1 according to the invention, in which the point of reference 26 is made brighter by concentrating or condensing the lateral edges of the collimated beam 5 in the frame 25, for example by making the beam 5 go through two cylindrical lenses 27 positioned on either side of the optical axis X-X' of the beam 5, or through any other optical device.

Figure 9:
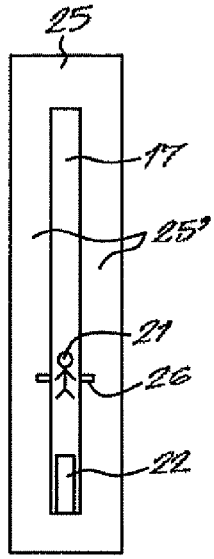
FIG. 9 is a view similar to that in FIG. 5, but for a sighting device according to FIGS. 7 and 8.

By concentrating lateral edges of the produced beam, the point of reference 26 is also made narrower, as illustrated in FIG. 9, which makes it easier to align it with the fore-sight 22.

An alternative solution to concentrate the luminous point of reference 26 is provided by the beam of a laser diode or laser pointer, situated in the same horizontal plane as the luminous source 7 of the red dot, and projected parallel to the optical axis X-X' of the collimator onto the frame of diffusion 25 of the sighting device 1.

This laser beam can be laterally expanded by an appropriate optical device, so as to form a linear spot or a line which constitutes the luminous reference (26).

This alternative is interesting in that the size of the reference 26 stays constant, irrespective of the angle of the mirror 9.

Figure 10:
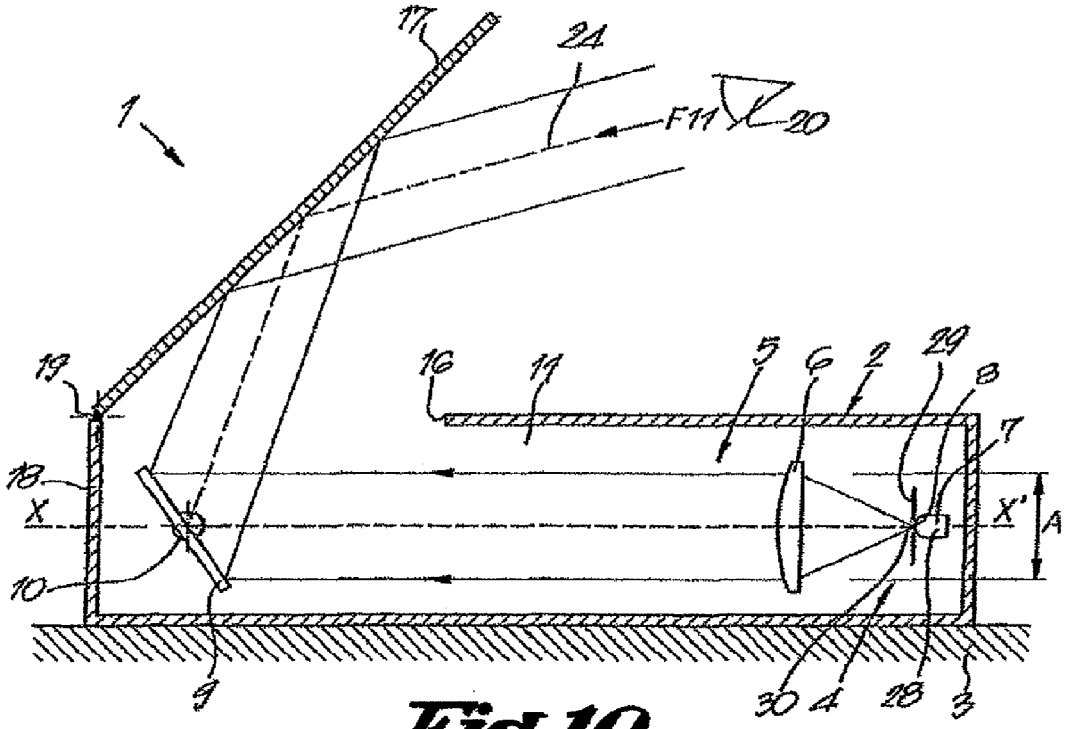
FIG. 10 is another variant of FIG. 1.

FIG. 10 represents another variant in which the luminous source 7 of the collimator for producing the red dot or reticle consists of a LED 28 with an appropriate intensity and emission angle, placed behind a mask 29 situated in the focal point 8 of the collimator and in which is formed a circular hole 30 or a hole of any other shape at the optical axis X-X'.

This variant makes it possible to realize a luminous source 7 with limited dimensions, which is important in view of the precision of the sighting device 1.

Indeed, the angle at which the red dot is projected to infinity and thus its apparent size at a given distance, is in proportion to the size of the luminous source 7 of the collimator and inversely proportional to the focal distance of the latter.

For example, in the case of a focal length of 40 mm, a circular luminous source 7 having a radius of 0.5 mm will produce a red dot whose apparent radius is:

$$0.5\times100/40=1.25 \text{ m at } 100 \text{ m}$$

$$0.5\times300/40=3.75 \text{ m at } 300 \text{ m}$$

Thus, the luminous source 7 must have limited dimensions, in order to provide a red dot with an apparent size which is compatible with the aimed target 21, which means that it must have a radius in the range of 0.1 to 0.2 mm.

It should be noted, however, that the dimensions of the luminous source 7 determine the quantity of light gathered by the lens 6 of the collimator, and consequently, the brightness of the luminous points of reference 26 projected onto the diffusing frame 25 of the sighting device 1. Hence, there is a conflict between the requirement of a small red dot and the necessity to obtain references 26 that are sufficiently bright for the preliminary alignment of the aiming axis with the fore-sight 22.

In order to reconcile both restrictions, it is advantageous to use, instead of a circular dot to be positioned on the target, a mark or reticle with a larger surface, inside of which the shooter has to visually place the target 21. It may be formed, for example, of two pointers 31 framing the target 21, as illustrated in FIGS. 11 to 12, which figures represent the perception of the reticle and the target 21 by a shooter who is aiming at a target at different distances, for example at 100, 200 and 300 meters respectively.

Figures 11, 12, 13, 14:
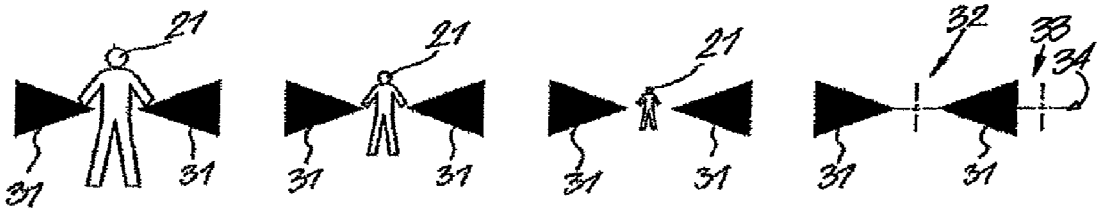
FIG. 11 is a view according to arrow F11 in FIG. 10.
FIGS. 12 and 13 are figures similar to FIG. 11, but for targets at a larger distance.
FIG. 14 is a variant of FIG. 11.

According to yet another variant, as represented in FIG. 14, also additional scales or marks 32, 33 can be included in the reticle, which enable the shooter to shift his firing axis so as to correct, when firing at long range, the trajectory error due to the rotation of the ammunition around its axis, better known as the Magnus effect.

FIG. 14 shows an example of a reticle which comprises an additional scale 33 on a horizontal axis 34, to be used when firing over more than 300 meters in the case of low-velocity grenades.

Instead of providing an additional scale 33 on the fixed reticle, one can also make sure that a simple reticle such as the one of FIG. 11 is automatically moved in the lateral direction by a device controlled by the ballistic calculator as a function of the type of ammunition used and the distance of the target, such that the deviation of the trajectory of the ammunition due to the Magnus effect is corrected.

The position of the reticle can also be moved perpendicularly to the optical axis by an adjusting device, so as to harmonize the sighting device with the launcher.

The use of a reticle with a marked horizontal axis 34 offers an additional advantage in that it forms a line of reference that helps the shooter, when aiming, to maintain his fire arm in a strictly vertical position, thus avoiding what are called "cant" errors which occur when the fire arm is laterally inclined.

This effect can be multiplied by making use of a mask which is free to pivot round the optical axis X-X' of the collimator, and which is ballasted with an unbalanced mass, which has for an effect that the reticle is kept at level, "in the manner of a plumb-line".

The inclination of the reticle in relation to the vertical axis of the frame of diffusion will make a possible error in the vertical position of the fire arm more noticeable to the shooter while aiming.

Moreover, if the sighting device 1 is controlled by a ballistic calculator equipped with an inclinometer which instantly measures the vertical deflection of the fire arm, this calculator may provoke, by means of an appropriate mechanism or device, an inclination of the reticle or of a horizontal line of reference round the optical axis of the collimator in proportion to the vertical deflection of the fire arm, possibly amplified with regard to the latter, such that it will be better perceived by the shooter while aiming.

The masks 29 which correspond to these various reticles can be realized by means of photolithography, which makes it possible to obtain dimensions in the order of one tenth of a millimeter, with resolutions of one hundredth of a millimeter.

It is clear that the reticles must not necessarily be red, but that reticles having another color, for example yellow-green, may also give a good contrast.

A non-monochromatic light source or "white" light can also be used.

It is also clear that the case 2 may have any shape whatsoever.

Instead of mounting the reflecting element 17 in a matt frame 25, the frame 25 can also be replaced by one or two lateral diffusion strips 25'.

Figure 15:
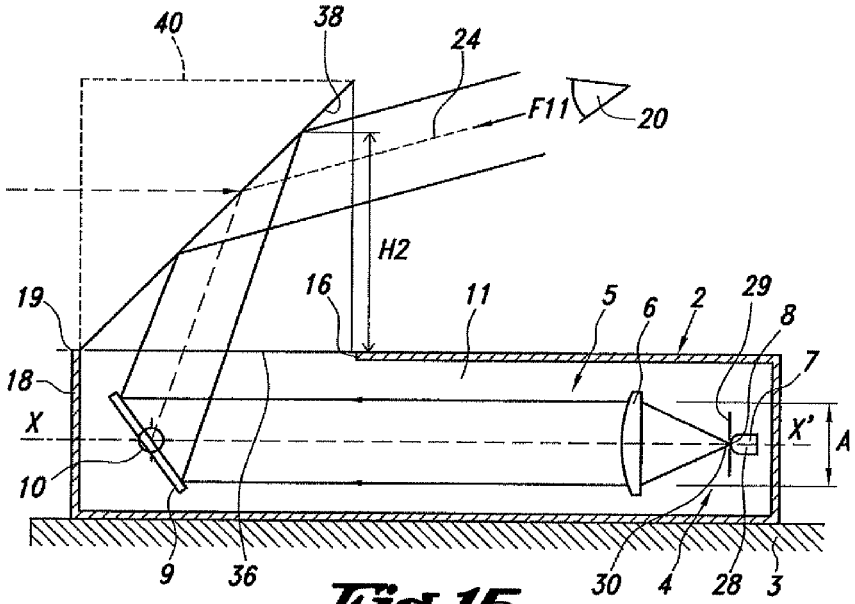
FIG. 15 is another variant of the invention.

As shown in FIG. 15, the reflecting element 17 may also comprise a single prism 36 or, optionally, a beamsplitter cube 40 which provides the advantage of reducing the overall height H2 of the reflecting element 17. In this embodiment, the reflecting surface is provided by the hypotenuse 38 of the prismatic system. The deviation of the reticle beam rays entering and exiting the prism at the air-prism interface reduces the height H2 required to reflect the reticle beam for the maximum elevation aiming angle B, thereby providing a more compact sighting device. A commercial BK7 glass prism with a refraction index around 1.5, with a hypotenuse length in the range of 28 mm, for example, will enable the sight to provide elevation aiming angles up to 35°. When a single prism is used, its hypotenuse surface is fully reflective, and the shooter cannot see the target through the prism with the aiming eye, which means that he has to aim with both eyes open. If a beamsplitter cube 40 is used, the beamsplitter surface is transparent relatively to the target, and thereby accommodates sighting by a single eye. In the case of a beamsplitter cube, a commercial BK7 beamsplitter cube with dimensions in the range of 20 mm×20 mm×20 mm can advantageously be used. Beamsplitter cubes are well-known and generally comprise two right angle prisms bonded together along their hypotenuse with appropriate interference coatings on the hypotenuse surfaces. While the prism 36 has been illustrated in conjunction with the embodiment of the invention according to FIG. 10, it will be understood that the prismatic reflecting reticle, including the beamsplitter cube, may be used with any embodiment of the invention.

It is clear that the invention is by no means limited to the examples described above, but that many modifications can be made to the above-described "moving red dot" sighting devices while still remaining within the scope of the invention as defined in the following claims.

The invention claimed is:

1. A "moving red dot" firearm sighting device, comprising a single, fixed, quasi punctual light source, a collimator comprising a convergent lens having a focal point, the light source located at the focal point, a semi-transparent beamsplitter, and a mirror located between the collimator and the beamsplitter, said mirror being rotatable about an inclination adjusting axis, wherein the light source and collimator project a collimated light beam along an optical axis which is projected onto the beamsplitter via the rotatable mirror so as to produce a red dot or reticle which is visible to a shooter due to the reflection of the collimated light beam on the beamsplitter, and wherein an inclination angle of the optical axis of the light beam projected onto the beamsplitter is adjustable by rotation of the mirror about the inclination adjusting axis.

2. The sighting device according to claim 1, wherein the sighting device is intended for use with a firearm shooting a given type of ammunition along a ballistic trajectory, comprising an adjusting device arranged to enable adjustment of the inclination angle of the mirror as a function of the distance of a target and of the given type of ammunition.

3. The sighting device according to claim 2, wherein the adjusting device includes a scale representing the distance of the target.

4. The sighting device according to claim 3, wherein the adjusting device includes several scales for different given types of ammunition.

5. The sighting device according to claim 2, wherein the adjusting device comprises a motor arranged to adjust the inclination angle of the mirror and a ballistic calculator controlling said motor enabling calculating and setting a required inclination angle of the mirror as a function of the distance of the target and/or of the given type of ammunition used.

6. The sighting device according to claim 5, wherein the ballistic calculator includes a range finder which is arranged to automatically communicate a distance of the target to the range finder when a calculation of the inclination angle is requested by a shooter.

7. The sighting device according to claim 1, wherein the diameter of the collimated light beam is about 15 mm or less.

8. The sighting device according to claim 1, said light source comprising an LED disposed behind a mask located at the focal point of the collimator lens, said mask having a hole located along the optical axis through which light from the LED projects to the collimator lens.

9. The sighting device according to claim 1, comprising a fore-sight placed at a point of convergence of axes of beams reflected on the beamsplitter.

10. The sighting device according to claim 1, comprising a lateral diffusion strip at one or both sides of the reflecting element onto which a luminous reference is projected parallel to the optical axis of the collimated beam.

11. The sighting device according to claim 10, wherein the luminous reference is formed by the collimated beam itself.

12. The sighting device according to claim 10, wherein the luminous reference comprises an optical condensation of the exterior parts of the collimated beam.

13. The sighting device according to claim 10, wherein the luminous reference is formed by a beam of a laser pointer having an axis extending mainly parallel to the optical axis of the collimated beam.

14. The sighting device according to claim 13, wherein the beam of the laser pointer is laterally expanded by an appropriate optical device so as to form a line which defines the luminous reference.

15. The sighting device according to claim 2, wherein the reticle comprises several marks which correspond, each for a determined distance of the target, to the required sighting correction so as to take into account the deviation of the trajectory of the given type of ammunition due to Magnus effect.

16. The sighting device according to claim 2, wherein the position of the reticle is automatically movable in a lateral direction by a device controllable by a ballistic calculator as a function of the given type of ammunition used and the distance of the target, so as to correct the deviation of the trajectory of the ammunition due to Magnus effect.

17. The sighting device according to claim 5, wherein the reticle comprises at least a horizontal reference and the ballistic calculator includes an inclinometer arranged to measure a vertical deflection of the firearm, wherein the calculator is arranged to adjust the inclination of the reference or of the reticle relative to the optical axis in proportion to the vertical deflection of the firearm, such that the reference or reticle will be better perceived by a shooter of the firearm while aiming.

18. The sighting device according to claim 1, wherein the sighting device includes a case supporting the light source, collimator, mirror and beamsplitter, the reflecting element extending upwardly relative to the case during use, and wherein the reflecting element is collapsible downwardly relative to the case to reduce of the height of the sighting device.

19. A "moving red dot" firearm sighting device, comprising a single, fixed, quasi punctual light source, a collimator comprising a convergent lens having a focal point, the light source located at the focal point, a reflecting element comprising the hypotenuse of a right angle prism, and a mirror located between the collimator and the hypotenuse of the right angle prism, said mirror being rotatable about an inclination adjusting axis, wherein the light source and collimator project a collimated light beam along an optical axis which is projected onto the hypotenuse of the right angle prism via the rotatable mirror so as to produce a red dot reticle which is visible to a shooter due to the reflection of the collimated light beam on the hypotenuse of the right angle prism, and wherein an inclination angle of the optical axis of the light beam projected onto the hypotenuse of the right angle prism is adjustable by rotation of the mirror about the inclination adjusting axis.

20. The sighting system according to claim 19, wherein the prism is a beamsplitter cube comprising two right angle prisms joined together along their respective hypotenuses.

* * * * *